US012601566B2

(12) United States Patent
Noorlander

(10) Patent No.: US 12,601,566 B2
(45) Date of Patent: Apr. 14, 2026

(54) HOWITZER TRAINING GUN

(71) Applicant: Van Halteren Metaal B.V., Bunschoten-Spakenburg (NL)

(72) Inventor: Eduard Noorlander, Bunschoten-Spakenburg (NL)

(73) Assignee: Van Halteren Metaal B.V., Bunschoten-Spakenburg (NL)

( * ) Notice: Subject to any disclaimer, the term of this patent is extended or adjusted under 35 U.S.C. 154(b) by 950 days.

(21) Appl. No.: 17/860,313

(22) Filed: Jul. 8, 2022

(65) Prior Publication Data

US 2023/0015221 A1 Jan. 19, 2023

(30) Foreign Application Priority Data

Jul. 8, 2021 (NL) ..... 2028658

(51) Int. Cl.
*F41G 3/26* (2006.01)
*F41A 23/28* (2006.01)
*F41A 33/00* (2006.01)

(52) U.S. Cl.
CPC ..... *F41G 3/26* (2013.01); *F41A 23/28* (2013.01); *F41A 33/00* (2013.01)

(58) Field of Classification Search
CPC .. F41G 3/26; F41A 23/28; F41A 33/00; F41A 9/82; F42B 8/12
USPC ..... 434/16
See application file for complete search history.

(56) References Cited

U.S. PATENT DOCUMENTS 2,497,085 A * 2/1950 Jeffers ..... F41A 33/00 434/24
2,656,765 A * 10/1953 Raymond ..... F41H 5/14 280/30
4,730,536 A * 3/1988 Nordmann ..... F41A 9/82 89/34
5,586,887 A * 12/1996 McNelis ..... F41G 3/2611 89/41.17
6,161,461 A * 12/2000 Hupfeld ..... F41A 33/00 89/45

* cited by examiner

*Primary Examiner* — Peter S Vasat
*Assistant Examiner* — Stephen Alvesteffer
(74) *Attorney, Agent, or Firm* — Peacock Law P.C.; Justin R. Muehlmeyer; Daniel J. Berenger-Russell

(57) ABSTRACT

A howitzer training gun with a gun carriage, a gun cradle supported by the gun carriage, a training gun barrel, and an unloading tray disposed at or near a forward end of the gun cradle, the unloading tray having a travel position and an operating position, and when in the operating position the unloading tray is arranged to receive a projectile from the training gun barrel and transfer the projectile to the ground.

12 Claims, 3 Drawing Sheets

HOWITZER TRAINING GUN

CROSS-REFERENCE TO RELATED APPLICATIONS

This application claims priority to and the benefit of Netherland Patent Application No. 2028658, titled "A Howitzer Training Gun", filed on Jul. 8, 2021, and the specification and claims thereof are incorporated herein by reference.

BACKGROUND OF THE INVENTION

Field of the Invention

The invention relates to a howitzer training gun provided with a gun carriage, a gun cradle supported by the gun carriage, and a training gun barrel with a sleigh.

Background Art

Howitzer guns are known from day to day use by the military. A howitzer training gun is provided by converting an original howitzer gun to a training gun by replacing the original gun barrel by a training gun barrel. The thus modified gun uses training ammunition with inductive tags. Embodiments of the present invention modify the howitzer training gun so as to better handle the projectiles that are loaded in the gun.

Discussion of any publications or traditional art herein is given for more complete background and is not to be construed as an admission that such publications are prior art for patentability determination purposes.

BRIEF SUMMARY OF THE INVENTION

According to an embodiment of the present invention, at or near a forward end of the gun cradle an unloading tray is disposed having a travel position and an operating position, and in the operating position the unloading tray is arranged to receive a projectile from the training gun barrel and transfer the projectile to the ground.

Preferably the unloading tray is rotatably mounted to the gun cradle. Suitably therefore the gun cradle is provided with an adapter frame and that the unloading tray is connected with a hinge to the adapter frame. This makes transferring between the travel position and operating position easy.

Preferably, the unloading tray is spring-loaded so as to arrange that the travel position is preferential, and that in the travel position the unloading tray provides a lock to the gun cradle.

Preferably, the unloading tray comprises a main frame and a drawer which is pivotably mounted to the main frame of the unloading tray, wherein the pivot is at the far end from the gun cradle. The drawer can then receive the projectile and pivot together with the drawer in the direction of the ground.

To maintain a best position to receive the projectile suitably the drawer is spring loaded with reference to the main frame of the unloading tray so as to provide that the drawer has a preferential and locked position substantially parallel to the main frame.

It is then advantageous that the drawer is provided with a release organ which can be activated by the projectile to unlock the drawer from the main frame of the unloading tray so as to enable pivoting of the drawer loaded with the projectile towards the ground.

In order to suitably handle the projectile all the way down to the ground, it is preferred that the drawer is provided with a slide to extend together with the projectile to the ground.

The slide is then preferably activated by arranging that the drawer is provided with a release switch distant from the pivot of the drawer with the main frame, which release switch can be operated by the projectile for release of the slide with the projectile in the extended direction of the drawer.

Further it is preferable that the slide has a central opening through which the projectile can eventually escape and fall to the ground.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

Whenever in the figures the same reference numerals are applied, these numerals refer to the same parts.

DETAILED DESCRIPTION OF THE INVENTION

FIGS. 1-7 demonstrate the initial gun conversion of a normal howitzer gun with an original gun barrel into a howitzer training gun provided with a training gun barrel, and subsequently the operation of an unloading tray mounted at the forward end of a howitzer cradle.

Figure 1:
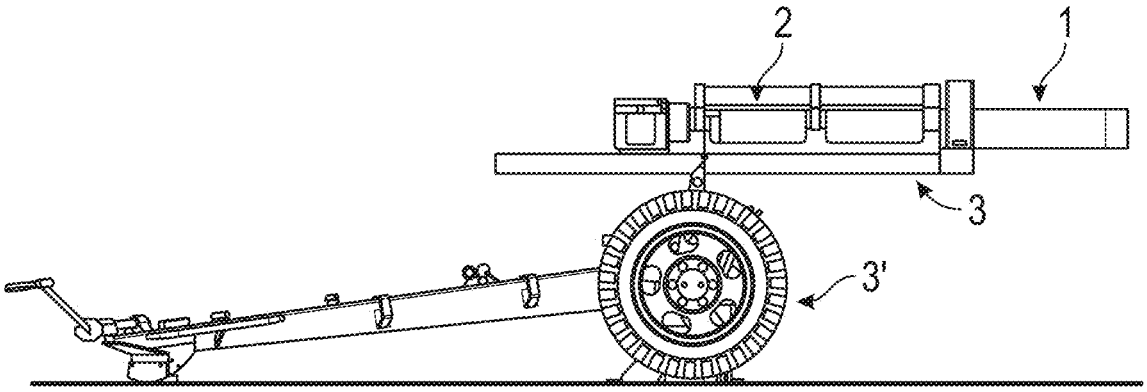
FIG. 1 is an illustration from a side view of a howitzer gun.

FIG. 1 shows a normal howitzer gun with original gun barrel 1, gun sleigh 2, and gun carriage 3' supporting gun cradle 3.

Figure 2:
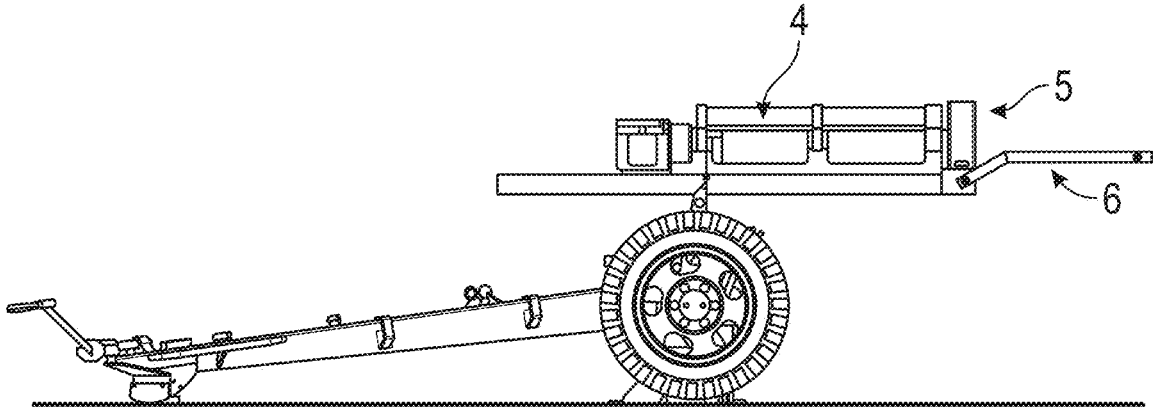
FIGS. 2-7 are illustrations from a side view of the howitzer gun of FIG. 1 after its conversion into a howitzer training gun and in various operating positions according to embodiments of the present invention.

In FIG. 2 the howitzer gun of FIG. 1 is shown after its conversion into a howitzer training gun, wherein original gun barrel 1 is replaced by training gun barrel 4. Original gun sleigh 2 and gun carriage 3' with gun cradle 3 are maintained, whereas gun cradle 3 is provided with adapter frame 5, on which unloading tray 6 is mounted according to an embodiment of the present invention.

As FIG. 2 illustrates, unloading tray 6 is provided at or near a forward end of gun cradle 3. Unloading tray 6 has a travel position and an operating position, wherein in the operating position unloading tray 6 is arranged to receive projectile 7 from training gun barrel 4 and transfer projectile 7 to the ground. Unloading tray 6 is illustrated in FIG. 2 in its travel position. In FIGS. 3-7 unloading tray 6 is shown in a series of operating positions.

It will be appreciated that unloading tray 6 is spring-loaded so as to arrange that the travel position shown in FIG. 2 is preferential. In the travel position of FIG. 2 unloading tray 6 provides a lock to gun cradle 3.

Figure 3:
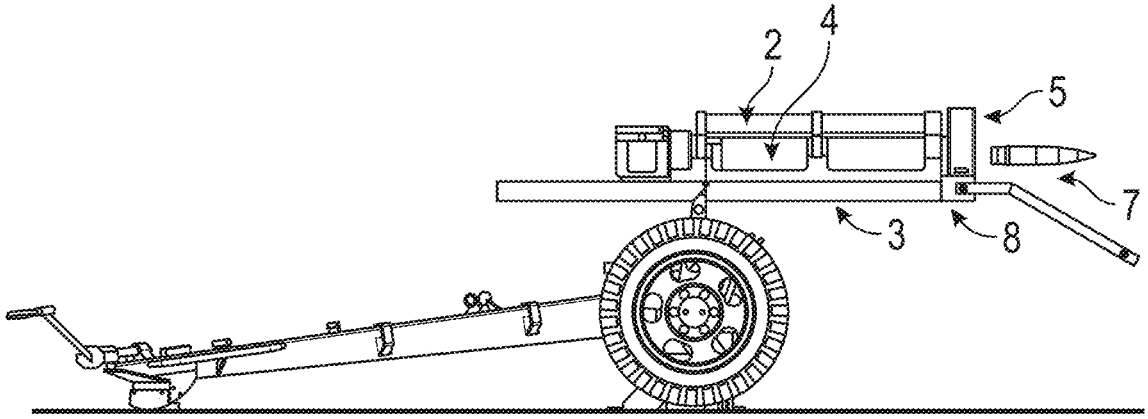
Figure 4:
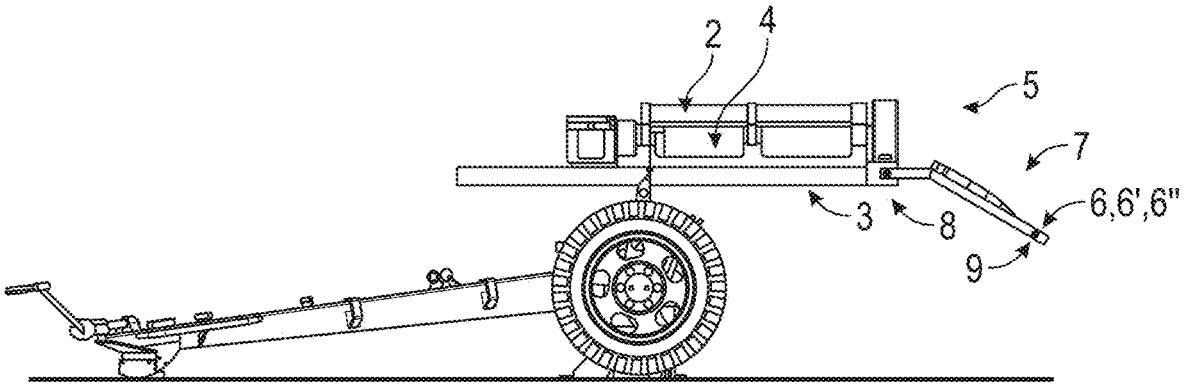

In a first operating position shown in FIG. 3 unloading tray 6 is arranged to receive projectile 7 from training gun barrel 4, which projectile 7 will eventually be transferred to the ground. It will be recognized from FIG. 4 that unloading tray 6 is rotatably mounted to gun cradle 3. To this end gun cradle 3 is provided with adapter frame 5 wherein unloading tray 6 is connected with hinge 8 to this adapter frame 5. In FIG. 4 projectile 7 is received on unloading tray 6.

Figure 5:
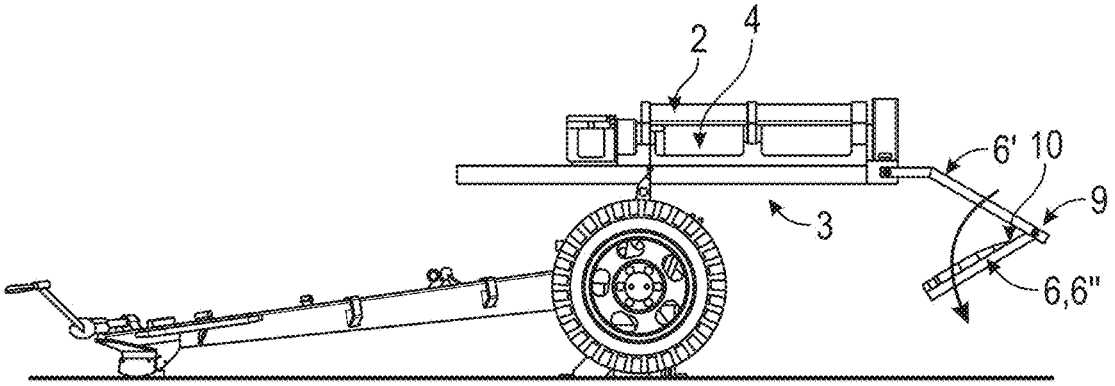
Figure 6:
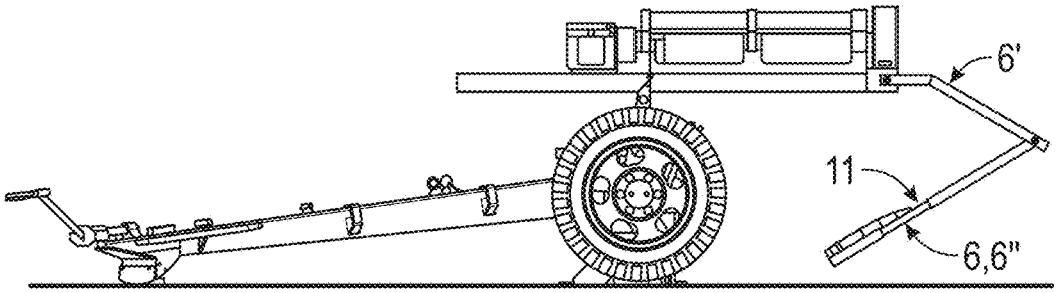

As is clear from FIGS. 5 and 6, unloading tray 6 comprises main frame 6' and drawer 6" which is pivotably mounted to main frame 6' of unloading tray 6. Pivot 9 that connects drawer 6" to main frame 6' is at the far end from gun cradle 3. Drawer 6" is spring loaded with reference to main frame 6' of unloading tray 6 so as to provide that drawer 6" has a preferential and locked position substantially parallel to main frame 6' as depicted in FIG. 4. On the other hand, drawer 6" is provided with release organ 10 which can be activated by projectile 7 to unlock drawer 6" from main frame 6' of unloading tray 6 so as to enable pivoting of drawer 6" loaded with projectile 7 towards the ground, such as depicted in FIG. 6.

Figure 7:
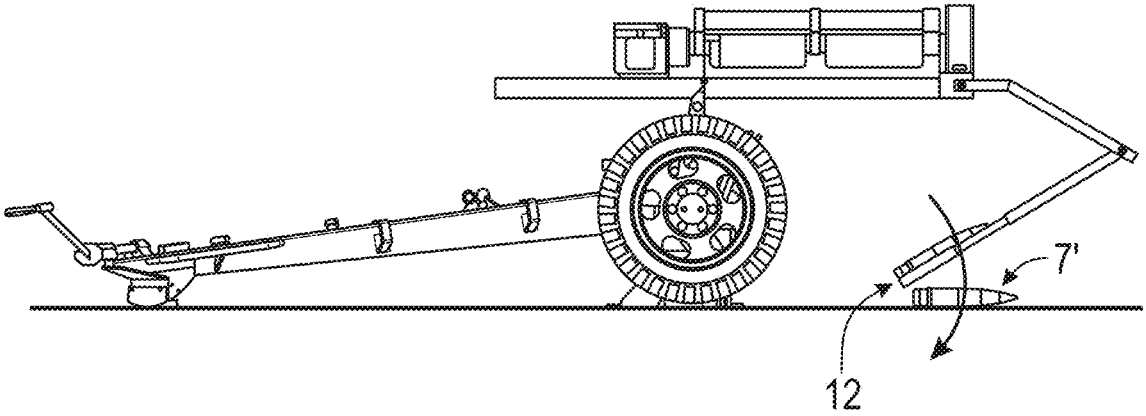

FIG. 7 shows that drawer 6" is provided with slide 11 to extend to the ground. In connection therewith, drawer 6" is provided with release switch 12 distant from pivot 6 of drawer 6" with main frame 6', which release switch 12 can be operated by projectile 7 for release of slide 11 with projectile 7 in the extended direction of drawer 6". Further slide 11 has a central opening (not shown) through which projectile 7 can escape and fall to the ground as symbolized by the depicted projectile 7'.

Although the invention has been discussed in the foregoing with reference to an exemplary embodiment of the howitzer training gun barrel with unloading tray according to the invention, the invention is not restricted to this particular embodiment which can be varied in many ways without departing from the invention. The discussed exemplary embodiment shall therefore not be used to construe the appended claims strictly in accordance therewith. On the contrary the embodiment is merely intended to explain the wording of the appended claims without intent to limit the claims to this exemplary embodiment. The scope of protection of the invention shall therefore be construed in accordance with the appended claims only, wherein a possible ambiguity in the wording of the claims shall be resolved using this exemplary embodiment.

Embodiments of the present invention can include every combination of features that are disclosed herein independently from each other. Although the invention has been described in detail with particular reference to the disclosed embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference. Unless specifically stated as being "essential" above, none of the various components or the interrelationship thereof are essential to the operation of the invention. Rather, desirable results can be achieved by substituting various components and/or reconfiguration of their relationships with one another.

The invention claimed is:

1. A howitzer training gun comprising:

a gun carriage;

a gun cradle supported by the gun carriage;

a training gun barrel comprising a sleigh, wherein the gun cradle comprises an unloading tray at or near its forward end, the unloading tray comprising a travel position and an operating position, and wherein in the operating position the unloading tray is arranged to receive a projectile from the training gun barrel and transfer the projectile to the ground;

wherein the unloading tray comprises a main frame and a drawer which is pivotably mounted to the main frame of the unloading tray, wherein the pivot is distant from the gun cradle; and wherein the drawer is spring loaded with reference to the main frame of the unloading tray so as to provide that the drawer has a preferential and locked position substantially parallel to the main frame.

2. The howitzer training gun of claim 1, wherein the unloading tray is rotatably mounted to the gun cradle.

3. The howitzer training gun of claim 2, wherein the gun cradle comprises an adapter frame and the unloading tray is connected with a hinge to the adapter frame.

4. The howitzer training gun of claim 1, wherein the unloading tray is spring-loaded so as to arrange that the travel position is preferential, and in the travel position the unloading tray provides a lock to the gun cradle.

5. The howitzer training gun of claim 1, wherein the drawer comprises a release organ which can be activated by the projectile to unlock the drawer from the main frame of the unloading tray so as to enable pivoting of the drawer loaded with the projectile towards the ground.

6. The howitzer training gun of claim 1, wherein the drawer comprises a slide to extend to the ground.

7. The howitzer training gun of claim 6, wherein the drawer comprises a release switch distant from a pivot of the drawer with the main frame, which release switch can be operated by the projectile for release of the slide with the projectile in the extended direction of the drawer.

8. A howitzer training gun comprising:

a gun carriage;

a gun cradle supported by the gun carriage;

a training gun barrel comprising a sleigh, wherein the gun cradle comprises an unloading tray at or near its forward end, the unloading tray comprising a travel position and an operating position, and wherein in the operating position the unloading tray is arranged to receive a projectile from the training gun barrel and transfer the projectile to the ground;

wherein the unloading tray comprises a main frame and a drawer which is pivotably mounted to the main frame of the unloading tray, wherein the pivot is distant from the gun cradle; and wherein the drawer comprises a release organ which can be activated by the projectile to unlock the drawer from the main frame of the unloading tray so as to enable pivoting of the drawer loaded with the projectile towards the ground.

9. The howitzer training gun of claim 8, wherein the drawer comprises a slide to extend to the ground.

10. A howitzer training gun comprising:

a gun carriage;

a gun cradle supported by the gun carriage;

a training gun barrel comprising a sleigh, wherein the gun cradle comprises an unloading tray at or near its forward end, the unloading tray comprising a travel position and an operating position, and wherein in the operating position the unloading tray is arranged to receive a projectile from the training gun barrel and transfer the projectile to the ground;

wherein the unloading tray comprises a main frame and a drawer which is pivotably mounted to the main frame of the unloading tray, wherein the pivot is distant from the gun cradle; and wherein the drawer comprises a slide to extend to the ground.

11. The howitzer training gun of claim 10, wherein the drawer comprises a release switch distant from a pivot of the drawer with the main frame, which release switch can be operated by the projectile for release of the slide with the projectile in the extended direction of the drawer.

12. The howitzer training gun of claim 10, wherein the slide comprises a central opening through which the projectile can escape and fall to the ground.

* * * * *